US011015439B1

(12) United States Patent
Saraya

(10) Patent No.: US 11,015,439 B1
(45) Date of Patent: May 25, 2021

(54) INTERVENTIONLESS METHODS AND SYSTEMS FOR TESTING A LINER TOP

(71) Applicant: Vertice Oil Tools, Missouri City, TX (US)

(72) Inventor: Mohamed Ibrahim Saraya, Sugarland, TX (US)

(73) Assignee: VERTICE OIL TOOLS INC, Missouri City, TX (US)

( * ) Notice: Subject to any disclaimer, the term of this patent is extended or adjusted under 35 U.S.C. 154(b) by 0 days.

(21) Appl. No.: 17/117,994

(22) Filed: Dec. 10, 2020

(51) Int. Cl.
*E21B 47/117* (2012.01)

(52) U.S. Cl.
CPC ..... *E21B 47/117* (2020.05)

(58) Field of Classification Search
CPC ..... E21B 47/117
USPC ..... 73/40.5 R
See application file for complete search history.

(56) References Cited

U.S. PATENT DOCUMENTS 10,435,958 B1 * 10/2019 Saraya ..... E21B 17/06

* cited by examiner

*Primary Examiner* — John Fitzgerald
*Assistant Examiner* — Rodney T Frank
(74) *Attorney, Agent, or Firm* — Pierson IP, PLLC

(57) ABSTRACT

Interventionless testing casing within a wellbore to determine a location where the casing is leaking. Testing systems include a casing disconnect tool to receive an object, such as a ball, allowing for pressurizing to test a backside between new casing associated with the disconnect tool and older casing associated with a cased hole or open hole.

16 Claims, 8 Drawing Sheets

INTERVENTIONLESS METHODS AND SYSTEMS FOR TESTING A LINER TOP

BACKGROUND INFORMATION

Field of the Disclosure

Examples of the present disclosure relate to interventionless systems and methods for testing casing within a wellbore to determine a location where the casing is leaking. More specifically, embodiments include a casing disconnect tool that receives a frac ball or a ball positioned on a rod to allow pressurizing to test a backside between new casing associated with the disconnect tool and older casing associated with a cased hole or open hole.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Conventionally, in oil and gas operations, casing is run all way to the surface to allow for the hydraulic fracturing. Other methods can include hanging the casing just above a horizontal or deviated section using a packer, a liner hanger, combination of both. Although this can be a cheaper method, it is still expensive and increases operational complexity.

Further, for refracturing jobs new casing must be run for a targeted zone, which must be isolated. This requires running new casing within the hole, pumping cement inside the casing, allowing the cement to return uphole in an annulus between the new casing and the old casing, and launching a wiper plug to sweep the pumped cement out of the new casing. Then, it is required to test this new casing/casing top to ensure pressure integrity before starting normal fracing procedure.

Conventionally, to test the casing is requiring to pressure up within the new casing. In normal situations the new casing interior and liner top hold pressure, requiring no further operation. However, some situations occur where the pressure up indicates there is leaking associated with the new casing/casing top. However, the locations of the leaking may be unknown, where the leaking may occur within the old casing or the shoe of the casing due to the wiper plug not landing properly. Currently to determine the location of the leaking it is required to run a retrievable packer or a plug, isolate the new casing shoe from the liner top, pressure up above the retrievable packer or the plug, determine the location of the leak, perform a squeeze job if liner top is the cause of leak and then remove the retrievable packer or the plug. This is an arduous and complex task that requires substantial effort, rig/coiled tubing time and money.

Accordingly, needs exist for systems and methods for interventionless testing of new casing associated with a disconnect tool for casing, wherein the disconnect tool includes a profile to receive a frac ball that is configured to allow pressurizing above the frac ball. Based on the pressure readings after testing the new casing it may be determined if the targeted zone is leaking requiring a squeeze job. However, if the testing indicates that the targeted zone is not leaking it may be assumed that there is a wet shoe that is leaking.

SUMMARY

Embodiments disclosed herein describe systems and methods for interventionless testing of new casing associated with a disconnect tool for new casing, wherein a squeeze job can be performed within the casing without running additional tools downhole. The disconnect tool may be configured to set new casing downhole with cement positioned in an annulus between an outer diameter of the new casing and an inner diameter of a cased hole or open hole. After positioning the disconnect tool downhole, the upper part of the disconnect tool can be then retrieved, leaving the new casing with a full open bore. To allow for later testing of the casing, the new casing run in hole via the disconnect tool that includes a profile configured to receive a frac ball/ball on rod. After the frac ball is positioned on the profile, pressurizing may occur above the frac ball to determine if there is leaking associated with the new casing top. Based on the pressure readings after the testing it may be determined if the targeted zone leak requires a squeeze job. However, if the testing indicates that the targeted zone is not leaking it may be assumed that there is a wet shoe that is leaking.

In embodiments, a bottom sub-assembly and casing may be configured to be selectively detached from an upper sub-assembly. This may allow for casing to be positioned with the wellbore efficiently and effectively, while other tools may be removed from the wellbore without having to cut tools downhole. Embodiments may include an upper sub-assembly, housing, and bottom sub-assembly that may be run in the wellbore as a single piece, wherein the bottom sub-assembly is configured to remain downhole as new casing after the upper sub-assembly and housing are retrieved from the wellbore. In other embodiments, the bottom sub assembly or housing may include a hanger system. The hanger system may be coupled to a piston and slips that are configured to expand/move to grip and/or anchor the bottom sub-assembly and housing to the old casing. In embodiments, the hanger system may be positioned on a distalmost end of the bottom sub-assembly.

The housing and the upper sub-assembly may be coupled together with offset fingers and grooves that are configured to be an anti-rotational lock. The anti-rotational lock may be utilized before the upper sub-assembly is disconnected from the bottom sub-assembly to limit the relative rotation of the upper sub-assembly and the housing.

The housing may have a distal end coupled the bottom sub-assembly. A proximal end of the housing may be positioned adjacent to the top sub-assembly. The housing may be positioned adjacent to a wellbore or within an inner diameter of existing casing, such that there is an annular space between the outer diameter of the housing and the inner diameter of the wellbore or existing casing. This may enable the tool to be positioned within existing casing, or next to the geological formation. In embodiments, the housing may include a no-go that is configured to decrease the inner diameter from a first inner diameter to a second inner diameter. The no-go may be configured to limit the movement of the upper sub-assembly towards the distal end of the housing in a first mode of operation, while allowing the movement of the upper sub-assembly towards the distal end of the housing in a second mode of operation. Furthermore, the housing may include a seat that is configured to receive a ball after the upper sub-assembly and housing are removed from the well. The housing may include an outer sidewall, support sleeve and adjuster sleeve. Further the tool may be connected to a seal bore extension. The seal bore extension may have an internal polished bore that is configured to accept seal assemblies that may be required for operation during later time of the well life. The seal bore extension may allow a seal assembly to provide a sealant between the annulus and the inside diameter of the casing. This may be needed to allow for a cement job remediation to the casing below the sealant through a squeeze job. Additionally, the seal assembly may be beneficial to isolate the annulus above the seal assembly from the produced well fluid during production operations.

The outer sidewall may be configured to be positioned adjacent to and on the distal end of the housing in the first mode of operation. The outer sidewall may have a same outer diameter as that of the housing.

The support sleeve may include a seat, first outcrop, second outcrop, and ports. The seat may be configured to decrease the inner diameter across the support sleeve, and allow a ball to rest within the support sleeve. Responsive to the ball being positioned on the seat, pressure within the tool above the ball may increase, allowing the support sleeve to detach from the adjuster sleeve at a first location and move towards the distal end of the wellbore. This may allow the support sleeve to move towards a distal end of the wellbore. In response to the support sleeve moving towards the distal end of the wellbore, the ports extending through the support sleeve may be utilized to indicate a pressure drop within the tool. In other concepts, the support sleeve may be connected to the bottom sub-assembly.

The adjuster sleeve may include an upper portion, shaft, and lower portion. The upper portion may include a groove, positioned on an inner sidewall of the adjuster sleeve, which is configured to receive the support sleeve in the first mode of operation. An outer sidewall of the adjuster sleeve may be configured to be positioned adjacent to the housing. The shaft of the adjuster sleeve may be configured to increase an inner diameter across adjuster sleeve between the upper portion and lower portion of the adjuster sleeve. In embodiments, the shaft may include a series of ports. The series of ports may be positioned above a proximal end of the support sleeve when the support sleeve is decoupled from the adjuster sleeve. The ports may be configured to allow communication between an inner diameter of the adjuster sleeve and annulus outside of the outer diameter of the adjuster sleeve. This may allow for the drainage of fluid from the inner diameter of the adjuster sleeve while the upper sub-assembly is being removed from the wellbore. The lower portion of the adjuster sleeve may include an inner projection and an outer projection. The inner projection may be configured to decrease the inner diameter of the lower portion of the adjuster sleeve, and the outer projection may be configured to increase the outer diameter of the lower portion of the adjuster sleeve.

The bottom sub-assembly may include a burst disc. In operation, the tool may be positioned within the wellbore. Pressure within the tool may be increased, and the burst disc may rupture. This may enable circulation at the top of the casing to circulate any excess cement that was bumped through the tool and through the casing shoe and back into the annulus side within the wellbore below the tool to return through the tool. In other embodiments, the burst disc may be positioned within the upper sub-assembly, and may be retrieved at the surface after the upper sub-assembly disconnects with the bottom sub-assembly.

The bottom sub-assembly may also include a cutout that allows for the linear movement of a support sleeve. In embodiments, the bottom sub-assembly and housing may be configured to be a permanent part of the casing liner downhole within the wellbore, and be configured to be coupled with a seal bore extension. This may be configured to seal an annulus between production tubing and the casing from a producing zone. The bottom sub-assembly and the housing may include a seal bore. The seal bore may be configured to allow a seal assembly to provide a sealant between the annulus and the inner diameter of the casing. This may be needed to allow for cement job remediation to the casing below the tool through preforming a cement squeeze job. Additionally, the seal bore may be beneficial to isolate the annulus above the seal bore from the produced well fluid during production operations.

In implementations, cement may be pumped downhole through the tool and be recirculated in an annulus between the tool and the existing casing or wellbore wall. The wiper plug may be pumped downhole, after pumping the cement, and through the tool to remove the cement from within tool and the new casing internal diameter. The wiper plug then lands on a landing collar/landing shoe at the bottom of the new casing on previously deployed casing to form a seal at the bottom of the new casing. Then operations may be performed to disconnect the upper sub-assembly, support sleeve, and adjuster sleeve from the wellbore the housing and the bottom sub-assembly, and remove the upper sub-assembly, support sleeve, and adjuster sleeve from the wellbore while the housing and the bottom sub-assembly remain downhole.

Once the new casing is set and conventionally tested by applying pressure from the surface, a leak may be detected and it is desired to test the new casing within the wellbore formed of the new cement, housing, and the bottom sub-assembly to determine a location of the leak. Conventionally to test liner top/casing, it was required to set a packer downhole, pressure up around the packer, and determine the location of the packer. In embodiments, a ball or other object may be configured to be positioned downhole within the housing or bottom sub-assembly without reducing the standard internal diameter of the casing, allowing the creation of two isolated fluid chambers, wherein a first chamber is positioned above the ball and a second chamber positioned below the ball. In some situations, the pressurization above the ball may indicate that there is a leak associated with a backside positioned within an annulus between the outer diameter of the tool and the old casing, and a squeeze job may be required. This type of leak is called in common practice liner top leak. If the pressurization above the ball indicates that there is no leak on the backside, then it may be determined that the tool has a wet shoe.

In further embodiments, the ball may be run in hole on a ported rod or with a sleeve, wherein the ported rod or the sleeve may be opened by pressure. For the simplicity, the terms ported rod or sleeve may be referred to as a ported rod throughout this document. The ported rod may be conveyed using pipes or coiled tubing and configured to perform the squeeze job. As such, the cement will be pumped through the pipes, coiled tubing, etc., and the ported rod may be configured to emit, pump, convey, etc. the cement at a location close to the backside of the casing while the ball is positioned on the seat. The cement can then be bull headed through the back side. Then the ported rod and the ball may be pulled out of hole. Accordingly, no milling is required for a squeeze job downhole, and the squeeze job and testing can be performed in a single run downhole.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
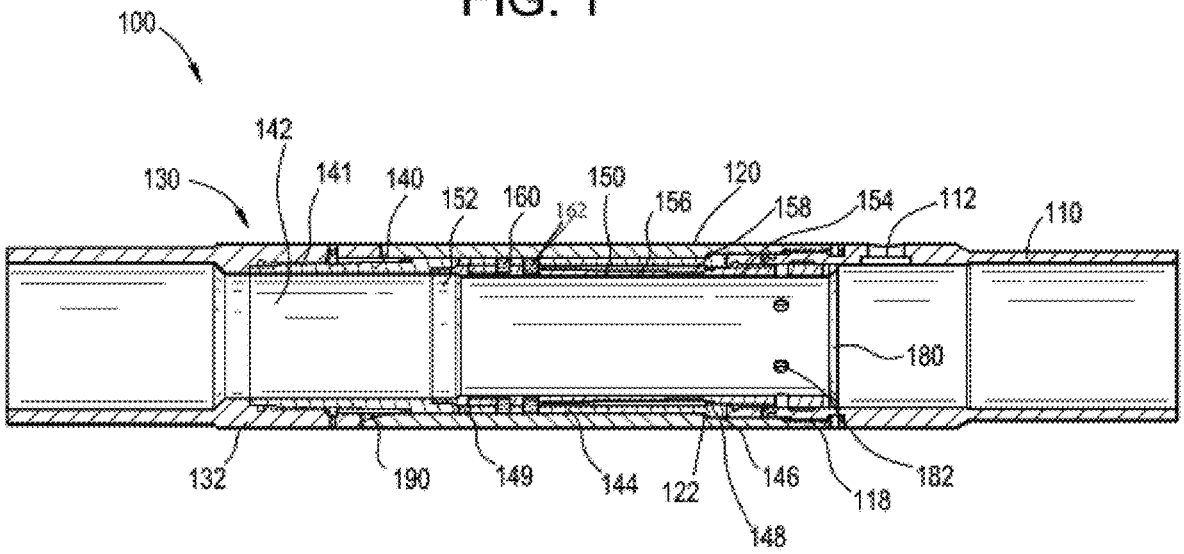
FIG. 1 depicts a tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a detachable tool 100 for use in a wellbore, according to an embodiment. In embodiments, the detachable tool 100 may be configured to be run in hole (RIH) as a unitary tool with a balanced pressure, wherein the connection between elements is not shearable while being RIH. In embodiments, a shearing element, such as a shear pin may be connected to a support sleeve 150, which supports the collet, and may be balanced as long as a ball is not seated on a ball seat. This may enable shearable, burstable, etc. elements of tool 100 to remain intact while being RIH. Tool 100 may include a bottom sub-assembly 110, housing 120, and upper-sub assembly 130.

Bottom sub-assembly 110 may be configured to be positioned at a distal end of a wellbore on a shoe. The bottom sub-assembly 110 may be configured to be a permanent part of casing, and remain within the wellbore after upper sub-assembly 130 is disconnected from housing 120. Bottom sub-assembly 110 may be configured to be positioned adjacent to casing liner downhole within the wellbore, and be configured to be coupled with a seal bore extension. This may be configured to seal an annulus between production tubing and the casing from a producing zone. Bottom sub-assembly 110 may include a burst disc 112, and coupling mechanism 118.

Burst disc 112 may be configured to be positioned in a passageway that extends from an inner diameter of tool 100 to an annulus positioned between tool 100 and another structure, such as an outside casing or a geological formation. Burst disc 112 may be configured to rupture, break, fragment, dissolve, etc. by applying a predetermined pressure across the rupture disc or after a predetermined amount of time. In embodiments, before burst disc 112 is ruptured the annulus between an outer diameter of tool 100 and the inner diameter of tool 100 may be isolated from each other. Responsive to burst disc 112 being ruptured, there may be communication between the annulus and the inner diameter of tool 100 via the exposed passageway. This may enable excess cement and fluid to travel through the passageway and towards the surface. In other embodiments, the burst disc may be placed in the housing or the upper sub-assembly 130 or directly adjacent to the collet.

Coupling mechanisms 118 may be positioned on an outer diameter of the proximal end of bottom sub-assembly 110. The coupling mechanisms 118 may be configured to selectively couple bottom sub-assembly 110 and housing 120. This may allow housing 120 to remain downhole after upper sub-assembly 130 is retrieved from the hole.

Housing 120 may be a sidewall with an outer diameter that is configured to be positioned adjacent to an outer casing, wall, cement, or geological formation. In embodiments, a distal end of housing 120 may be coupled to bottom sub-assembly 110, and a proximal end of housing 120 may be coupled to top sub-assembly 130. The proximal end of housing 120 may include a beveled anti-rotational lock 190. Anti-rotational lock 190 may be configured to limit the rotation of upper sub-assembly 130 with respect to the housing 120. The anti-rotational lock 190 may include a first set of fingers and a first set of grooves, which may be configured to be interfaced with a second set of fingers and a second set of grooves on the outer sidewall of the upper sub-assembly. In embodiments, the beveled, sloped, tapered, etc. edges, of anti-rotational lock 190 may be configured to assist with re-entry of further tools within an inner diameter housing 120.

An upper portion of housing 120 may have a first inner diameter, and a bottom portion of housing 120 may have a second inner diameter, wherein the second inner diameter is greater than the first inner diameter. A stop, no-go, outcrop, etc. 122 may be positioned between the upper and lower portions of housing 120, wherein no-go 122 may be configured to limit the movement of upper sub-assembly 130 when shear pin 160 is coupling adjuster sleeve 140 and support sleeve 150. As such, when adjuster sleeve 140 and support sleeve 150 are coupled together via shear pin 160, no-go 122 may form an overhang over portions of adjuster sleeve 140. This may limit the movement of upper sub-assembly towards the proximal end of tool 100 when portions of adjuster sleeve 140 are aligned with no-go 122. However, when portions of adjuster sleeve 140 are not aligned with no-go 122, upper sub-assembly 130 may move towards the proximal end of tool 100. This may enable the removal of upper sub-assembly 130. In an alternative embodiment, the no-go 122 may be part of the bottom sub-assembly 110 while the collet 144 may be connected to the upper sub-assembly. In further embodiments, housing 120 may include a ball seat, projection, etc. that is position on an inner diameter of housing 120. The ball seat may be configured to receive a ball after upper sub-assembly is disconnected from housing and removed from the wellbore. In such embodiment, with the ball seat positioned on the housing, rupture disc 112 may be removed from bottom sub assembly 110, or positioned on upper sub assembly 130.

Upper sub-assembly 130 is configured to be inserted and removed from a wellbore independently from bottom sub-assembly 110 and/or housing 120. Responsive to increasing the pressure or apply of force within tool 100, portions of upper sub-assembly may be repositioned and form a mechanical look that is not aligned with housing 120. This may allow upper sub-assembly 130 to move towards the proximal end of the wellbore. Upper sub-assembly 130 may include an outer sidewall 132, adjuster sleeve 140, and a support sleeve 150. Further, in other embodiments, upper sub-assembly 130 may include rupture disc 112.

Outer sidewall 132 may be configured to be positioned on and adjacent to a proximal end of housing 120. By positioning outer sidewall 132 on housing 120, movement of upper sub-assembly 130 towards the distal end of tool 100 may be limited. An inner portion of outer sidewall 132 may be configured to be coupled to a proximal end of adjuster sleeve 140. A distal end of outer sidewall 132 may include an anti-rotational lock that is configured to mate with anti-rotational lock 190. Responsive to mating the anti-rotational locks, the rotation of upper sub-assembly 130 with respect to the housing 120 may be limited. The second set of anti-rotational locks positioned on the distal end of outer sidewall may include a second set of fingers and a second set of grooves. These second sets of fingers and grooves may be configured to be offset from the first set of fingers of grooves. For example, a first finger associated with the housing 120 is inserted into a second groove associated with the outer sidewall 132 and a second finger associated with outer sidewall 132 is configured to be inserted into a first groove housing 120.

Adjuster sleeve 140 may be a sleeve with a collet that is configured to remain coupled to outer sidewall 132 while support sleeve 150 moves towards a distal end of the wellbore. Adjuster sleeve 140 may include a coupling mechanism 141, upper portion 142, shear pin 160, shaft 144, a distal end that includes an outer projection 146 and an inner projection 148, and port 149.

The upper portion 142 of adjuster sleeve 140 may be configured to be coupled with outer sidewall 132 via coupling mechanism 141. Upper portion 142 may include a cutout 170 that is configured to receive a proximal end of support sleeve 150, when support sleeve 150 is in a first position. In embodiments, support sleeve 150 may be retained in the first position until the pressure within tool 100 increases past a threshold to cut/severe shear pin 160. This may decouple adjuster sleeve 140 and support sleeve 150 at a location associated with shear pin 160. In other embodiments, the adjuster sleeve 140 and the outer side wall 132 may be one piece.

Shaft 144 may be positioned between upper portion 142 and the distal end of adjuster sleeve 140. Shaft 144 may be configured to be positioned adjacent to an inner sidewall of housing 120 while upper sub-assembly 130 is coupled with bottom sub-assembly 110. Shaft 144 may be configured to extend past shear pins 160 from upper portion 142 to the collet positioned on a distal end of adjuster sleeve 140. An inner diameter across shaft 144 may be greater than an inner diameter across the distal end of adjuster sleeve 140 and upper portion 142. In embodiments, shaft 144 may be spring loaded, have a natural flex, etc. that naturally moves the distal end of shaft 144 towards a central axis of tool 100. In other configurations, the shaft can be connecting to dogs, dies, etc.

Distal end of adjuster sleeve 140 may be a collet or any other mechanism that is configured to be selectively coupled to housing 120 at a first location or support sleeve 150 at a second location. This may enable upper sub-assembly 130 to be selectively coupled to bottom sub-assembly 110, while allowing upper sub-assembly 130 to be mechanically removed from a wellbore. Distal end of adjuster sleeve 140 may include an outer projection 146 and an inner projection 148.

Outer projection 146 may be positioned on an outer sidewall of the distal end of adjuster sleeve 140, and may increase the outer diameter of the distal end of adjuster sleeve 140. Outer projection 146 may be configured to be vertically aligned with no-go 122 in the first mode of operation. This may limit the upward movement of adjuster sleeve 140 while outer projection 146 is aligned with no-go 122. In the second mode, outer projection 146 may not be aligned with no-go 122, such the adjuster sleeve 140 may move unrestricted by no-go 122.

The outer projection 146 may be collets that flex open, dies that retract, dogs supported with spring, or any other device that naturally or through mechanical assistance may have first larger diameter and second smaller diameters Inner projection 148 may be positioned on an inner sidewall of the distal end of adjuster sleeve 140, and may decrease the inner diameter of the distal end of adjuster sleeve 140. Inner projection 146 may be configured to be positioned adjacent to first outcrop 154 of support sleeve 150 in the first mode of operation. In the second mode of operation, inner projection 146 may be configured to be positioned within a groove between first outcrop 154 and second outcrop 156, and may be positioned adjacent to second outcrop 156. This may enable inner projection to apply a force against second outcrop 156 and move support sleeve 150.

Port 149 may be an orifice extending from an inner circumference of adjuster sleeve 140 to an outer circumference of adjuster sleeve 140. Port 149 may be positioned closer to a proximal end of adjuster sleeve 140 than a distal end of adjuster sleeve 140. Port 149 may be configured to allow communication between an inner diameter of adjuster sleeve 140 and an annulus outside of adjuster sleeve 140 while upper sub-assembly 130 is being removed from the wellbore. However, shear pin 160 is coupling adjuster sleeve 140 and support sleeve 150, an inlet of port 149 may be covered by support sleeve 150 and an outlet of port 149 may be covered by housing 120. Furthermore, when upper sub-assembly 130 is being removed from the wellbore, a proximal end of support sleeve 150 may be positioned below port 149, which may allow for the communication between the inner diameter of adjuster sleeve 140 and the annulus.

Support sleeve 150 may be a device that is configured to be selectively coupled to adjuster sleeve 140 at either a first location or second location, and to move along a linear axis of tool 100. Support sleeve 150 may move towards a distal end of tool 100 responsive to a ball drop and seating on seat 152 and a pressure increase within tool 100, and may move towards a proximal end of tool 100 responsive to adjuster sleeve 140 applying pressure to support sleeve 150 towards the proximal end of tool 100. Support sleeve 150 may include a seat 152, first outcrop 154, and second outcrop 156.

Seat 152 may be a projection extending around the inner circumference of support sleeve 150, which may decrease the inner diameter of support sleeve 150. Seat 152 may be configured to receive a ball, disc, object, seal, etc., and restrict the movement of the ball towards the distal end of tool 100. This may isolate a first area within the tool 100 above seat 152 from a second area within the tool 100 below seat 152. In embodiments, responsive to positioning the ball on seat 152, the pressure within the first area may increase, shearing pin 160, and moving support sleeve 150 towards the distal end of tool 100. In further embodiments, seat 152 may be coupled with an inner support that is configured to mechanically intervene and shear shearing pin 160. This may enable a failsafe to disconnect the upper sub-assembly 130 from bottom sub-assembly that is mechanically operated.

First outcrop 154 and second outcrop 156 may be positioned on an outer diameter of support sleeve 150. First outcrop 154 and second outcrop 156 may increase the size of the outer diameter of support sleeve 150 such that a slot 158 may be formed between first outcrop 154 and second outcrop 156. In embodiments, first outcrop 154 may have a smaller outer diameter than that of second outcrop 156.

First outcrop 154 may be configured to be aligned with inner projection 148 in the first mode, which may limit the movement of the distal end of adjuster sleeve 140 towards a central axis of tool 100. In the second mode, the distal end of adjuster sleeve 140 may be aligned the groove/slot between first outcrop 154 and second outcrop 156, and the distal end of adjuster sleeve 140 may be coupled to support sleeve 150 at a second location.

Support sleeve 150 may also include a tapered distal end 180, and ports 182. The tapered distal end 180 may be a beveled, slopped, angled, etc. end that is configured to assist in positioning support sleeve within bottom sub-assembly 110. Ports 182 may be configured to allow for a communication bypass around the proximal end of support sleeve 150, between support sleeve 150 and adjuster sleeve 140 when the two are detached, and into the inner diameter of bottom sub assembly 110. This communication bypass may be configured to allow for a pressure drop indication within the wellbore due to the shearing or shear pin 160. Support sleeve 160 may be coupled to adjuster sleeve 140 via retaining pins 162, which couple the support sleeve 150 to adjuster sleeve 140 after support sleeve 150 has sheared.

Figure 2:
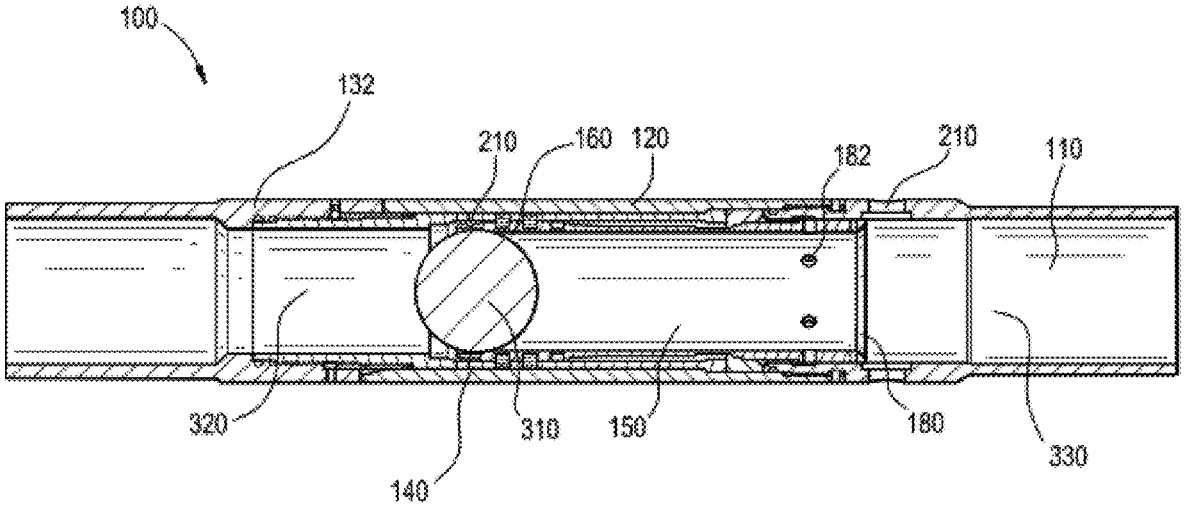
FIG. 2 depicts a tool, according to an embodiment.

FIG. 2 depicts tool 100, according to an embodiment. Elements depicted in FIG. 2 may be described above, and for the sake of brevity a further description of these matters is omitted.

As depicted in FIG. 2, responsive to burst disc 112 being ruptured or due to existence of a wet shoe, passageway 210 extending from an inner diameter of tool 100 to an annulus positioned outside of tool 100 may be exposed. This may allow for communication between the annulus and inner diameter of tool 100.

A ball 310 may be configured to sit on seat 152. Responsive to positioning ball 310 on seat 152, a first area 320 above ball 310 within the inner diameter of tool 100 may be isolated from a second area 330 positioned below ball 310 except through bypass 210.

Bypass 210 may be created within a space between the outer diameter of support sleeve 150 and the inner diameter of adjuster sleeve 120 and bottom sub-assembly. More so, the bypass 210 may be created responsive to shear pin 160 shearing, allowing support sleeve 150 to move down well.

Responsive to the pressure within the first area 320 increasing past a threshold, shear pin 160 may shear. This may decouple support sleeve 150 from adjuster sleeve 140 at the first location, allowing support sleeve 150 to move towards the distal end of tool 100.

When support sleeve 150 moves towards the distal end of tool 100, inner projection 148 may be positioned between first outcrop 154 and second outcrop 156. This may enable outer projection 146 to be positioned away from no-go 122.

Furthermore, when inner projection 148 is between first outcrop 154 and second outcrop 156, support sleeve 150 may be mechanically coupled to adjuster sleeve 140 at a second location, which is a different location than the first position of shear pin 160.

Figure 3:
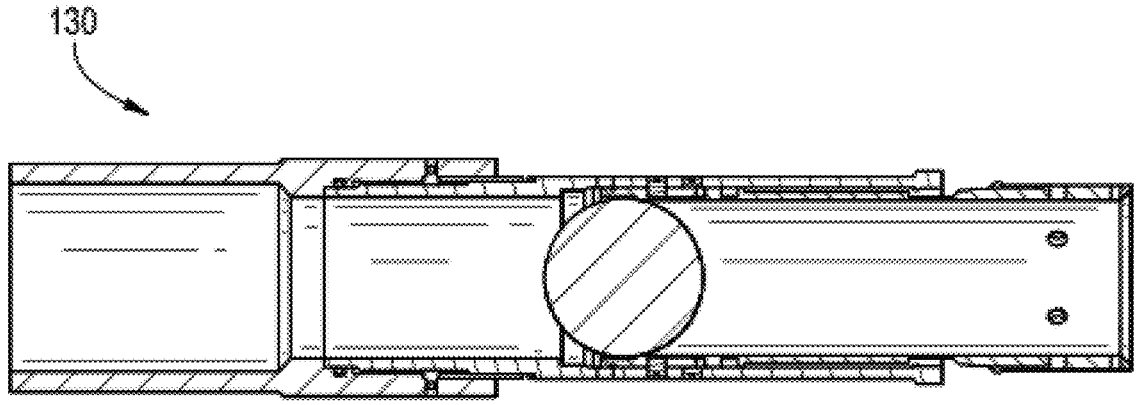
FIG. 3 depicts an upper sub-assembly according to an embodiment.

FIG. 3 depicts upper sub-assembly 130, according to an embodiment. Elements depicted in FIG. 3 may be described above, and for the sake of brevity a further description of these matters is omitted.

Responsive to upper sub-assembly 130 being detached from housing 120 and bottom sub-assembly 110, upper sub-assembly 130 may be removed from a wellbore, while housing 120 and bottom sub-assembly remain in the wellbore.

Figure 4:
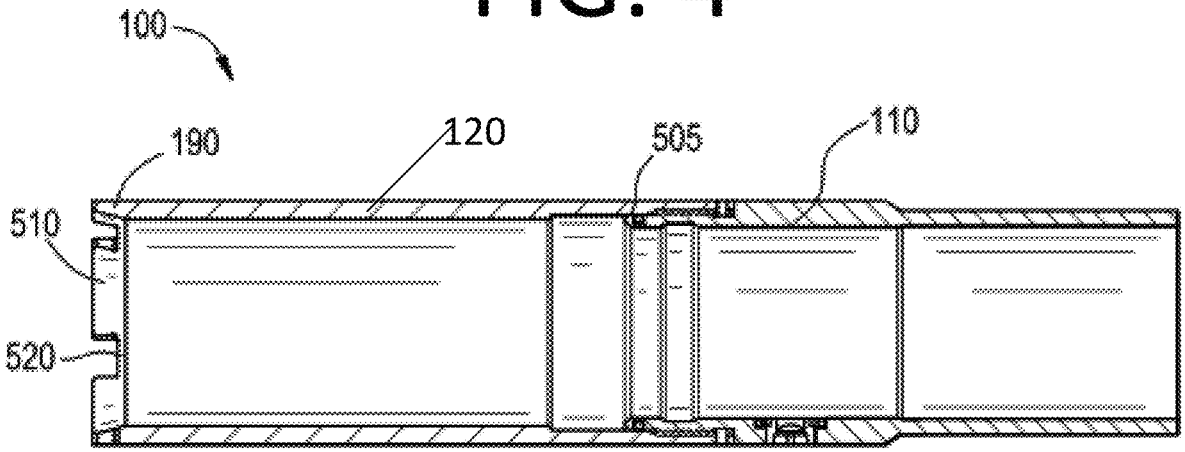
FIG. 4 depicts a bottom sub-assembly and housing, according to an embodiment.

FIG. 4 depicts tool 100 that is configured to remain downhole after upper sub-assembly 130 is disconnected from lower sub assembly 110, according to an embodiment. Elements depicted in FIG. 4 may be described above, and for the sake of brevity a further description of these matters is omitted.

After upper sub-assembly 130 receives an upward force or the casing getting downward force, upper-sub assembly may 130 may become detached from housing 120 and bottom sub-assembly 110. This may enable portions of tool 100 to be separated and removed from a wellbore. Responsive to upper sub-assembly 130 being detached from housing 120 and bottom sub-assembly 110, only housing 120 and bottom sub-assembly 110 may remain in the wellbore. This may enable upper sub-assembly 130 to be removed from the wellbore.

Furthermore, FIG. 4 depicts a beveled proximal end of housing 120, which included anti-rotational lock 190. Anti-rotational lock 190 includes a set of first fingers 510, and a set of first grooves 520. This first set of fingers and grooves may be configured to be interfaces with a second set of fingers and grooves on a distal end of the outer sidewall of the upper sub-assembly. Additionally, a proximal end of bottom sub-assembly 110 may include a beveled rim 505, edge, etc. This may allow for an easier insertion of various tubing, tools, etc. through the wellbore, while operating as a no-go to limit the downward movement of the support sleeve after it shears. In embodiments, rim 505 may be configured to be a ball seat, wherein a ball is configured to land on rim 505. By positioning the ball seat on the proximal end of bottom sub-assembly 110 an additional reduction of an inner diameter of tool 100 may not be required.

Figure 5:
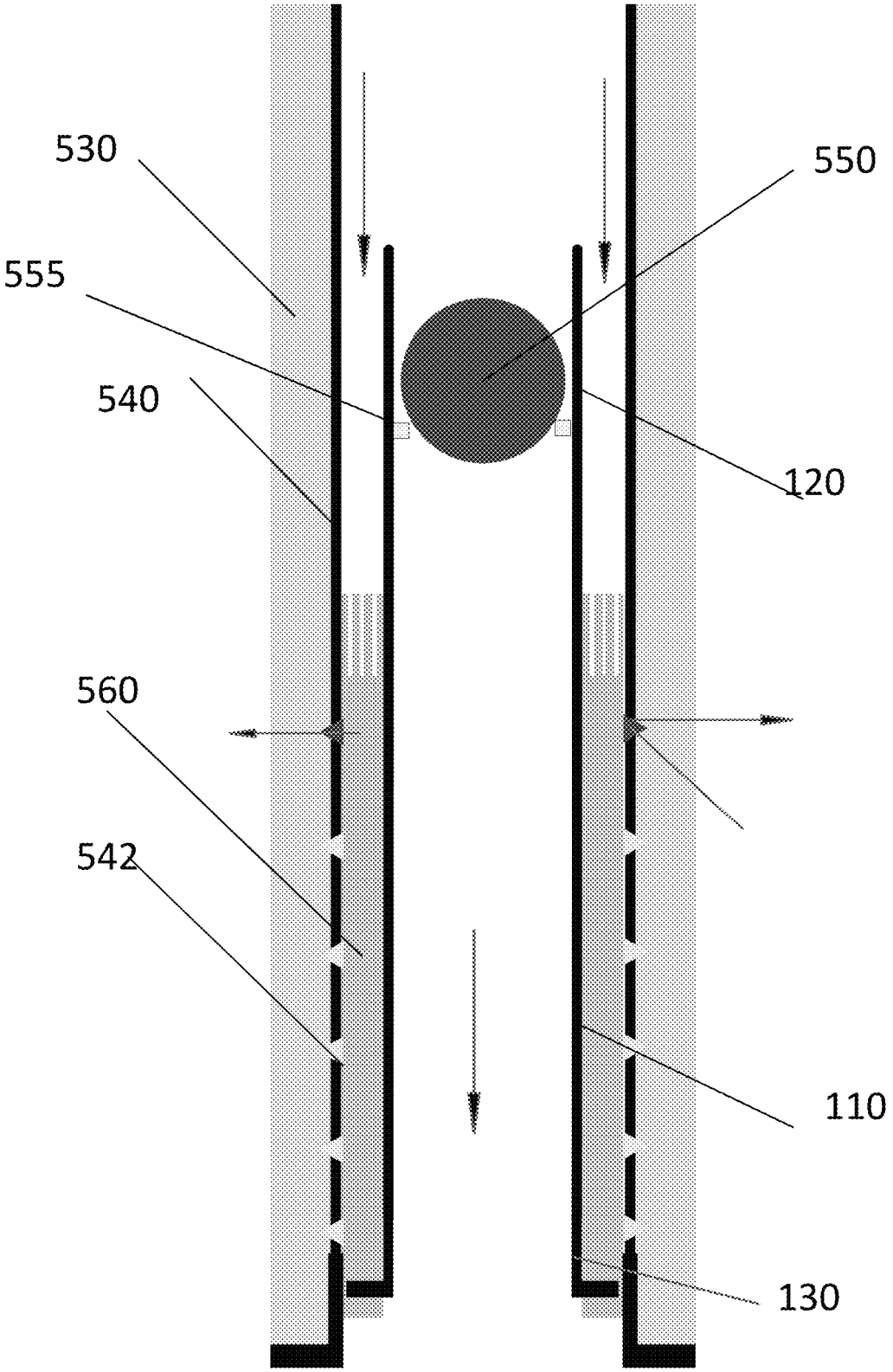
FIG. 5 depicts a bottom sub-assembly and housing, according to an embodiment.

FIG. 5 depicts housing 120 and bottom sub-assembly 110 being positioned downhole after upper sub-assembly 130 is removed from the wellbore. Elements depicted in FIG. 5 may be described above, and for the sake of brevity a further description of these elements may be omitted.

Tool 100 may be run in hole as a unified element, wherein tool 100 may be run in hole within a new hole with no casing or run in hole within a cased hole. In embodiments, tool 100 may be run in hole in a previously cased 540 hole, wherein production associated with previously perforations 542 has decreased. Tool 100 may be run in hole to a desired depth, and be positioned adjacent to a casing shoe. Cement 560 may be pumped through an inner diameter of tool 100, exit out the bottom of tool 100, and return in an annulus positioned between an outer circumference of tool 100 and the existing casing 540. Then, a wiper may be pumped downhole through the inner diameter of tool 100 to sweep the pump cement out of the bottom of tool 100, wherein the wiper may be pumped to the casing shoe positioned at the bottom of tool 100, wherein the shoe may be an exit point of tool 100. Then, procedures as described above may be performed to disconnect the upper sub-assembly from housing 120 and lower sub assembly 110, which may allow housing 120 and bottom sub-assembly 110 to remain downhole. As such, an upper surface of housing 120 may become a top piece of a casing liner downhole.

To test the new casing formed of housing 120 and bottom sub-assembly 110, pressure within the hole may be increased. This increase in pressure for the testing may indicate that the new casing formed of housing 120, bottom sub-assembly, and cement 560 is leaking. However, the location of the leak may be currently unknown, and may be located from behind the casing in an old perforation 560 or a leak at the casing shoe because tool 100 did not land properly on the casing shoe.

A ball 550, object, etc. may be configured to be land on a profile 555, indentation, etc. positioned on an inner diameter of housing 120 or bottom sub-assembly 110. When ball 550 is positioned on profile 555, a first chamber positioned above ball 550 may be isolated from a second chamber positioned below ball 550. In embodiments, ball 550 may be a dissolvable ball, magnetic ball, etc. When ball 550 is positioned on profile 555, pressure within the first chamber above ball 550 within the hole may be increased. If pressure is leaking above ball 550, then it may be determined that backside between cement 560 and existing perforations 560 is leaking and a squeeze job is required, wherein additional cement is positioned in the annulus between housing 120 and existing casing 540. If pressure is not leaking above ball 550, then it may be determined that pressure is leaking in the second chamber there is a wet shoe, which may be remediated.

Due to ball 550 being a dissolvable ball, no additional intervention is required to remove ball 550. Ball 550 may gradually decrease in size and pass through tool 100.

Figure 6:
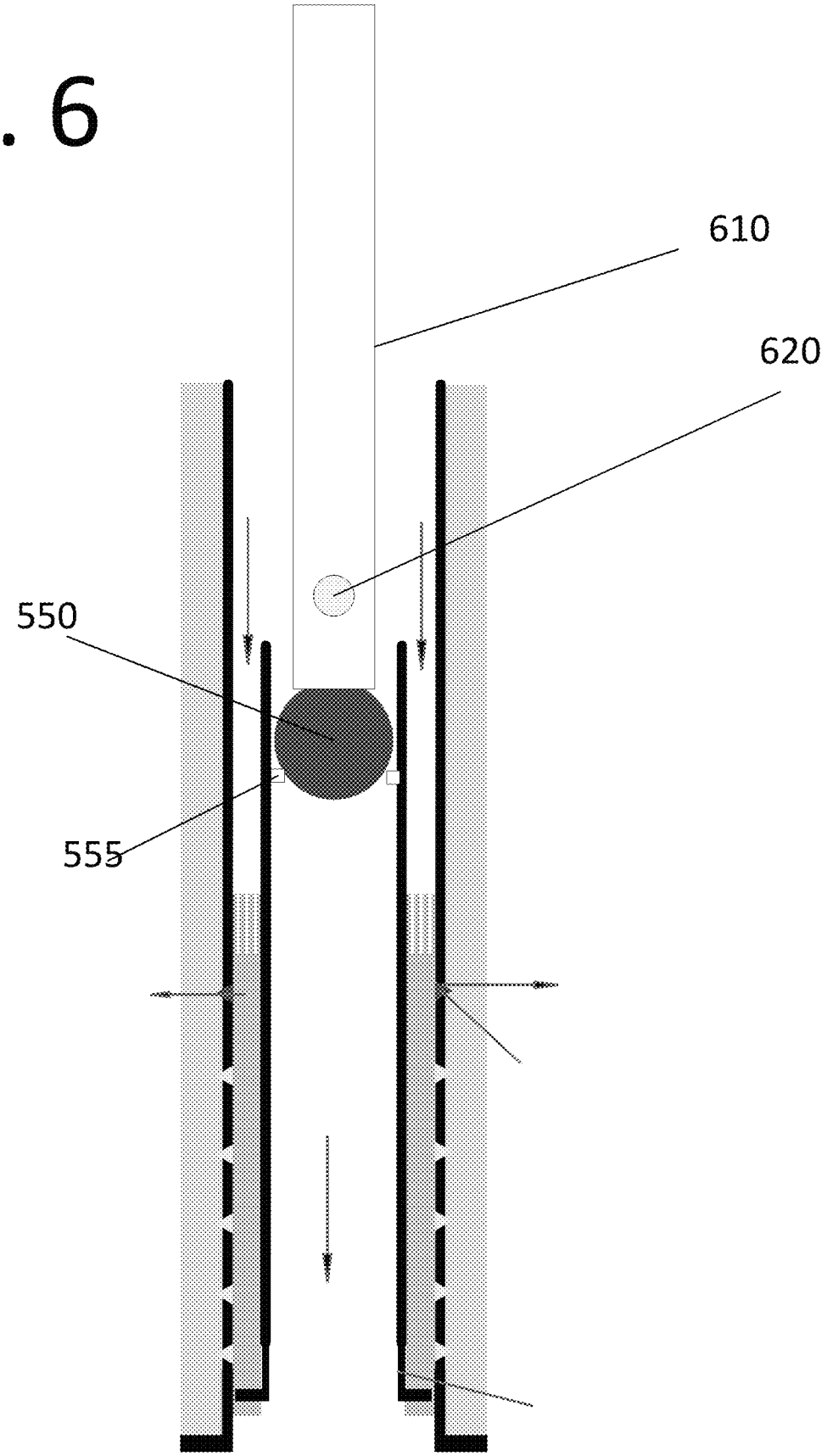
FIG. 6 depicts an interventionless tool for testing a new casing and performing a squeeze job in a single run, according to an embodiment.

FIG. 6 depicts housing 120 and bottom sub-assembly 110 being positioned downhole after upper sub-assembly 130 is removed from the wellbore. Elements depicted in FIG. 6 may be described above, and for the sake of brevity a further description of these elements may be omitted.

As depicted in FIG. 6, ball 550 may be run in hole on a rod 610. Rod 610 may be a hollow rod or a sliding sleeve that open on demand, which may be coupled to a drill pipe, coiled tubing, or any other conveying mechanism. In embodiments, a distal portion of rod 610 may include ports 620, and rod 610 may have a closed distal end that is covered by and coupled to ball 550. Responsive to ball 550 landing on profile 555, to isolate the first chamber from the second chamber, cement may be pumped through rod 610 and be emitted/displaced out of rod through ports 620. The emitted cement may be emitted from ports 620 at a location close to an opening of the annulus between tool 100 and existing casing 540, i.e.: liner top. This may enable the squeeze job to be more effectively and efficiently performed directly at the linear top formed by tool 100. After the squeeze job, rod 610 and ball 550 may be pulled out of hole. This allows a squeeze job to be performed directly after testing without having to position complex packers across an inner diameter of tool 100, which would require multiple trips, milling, and/or tools.

Figure 7:
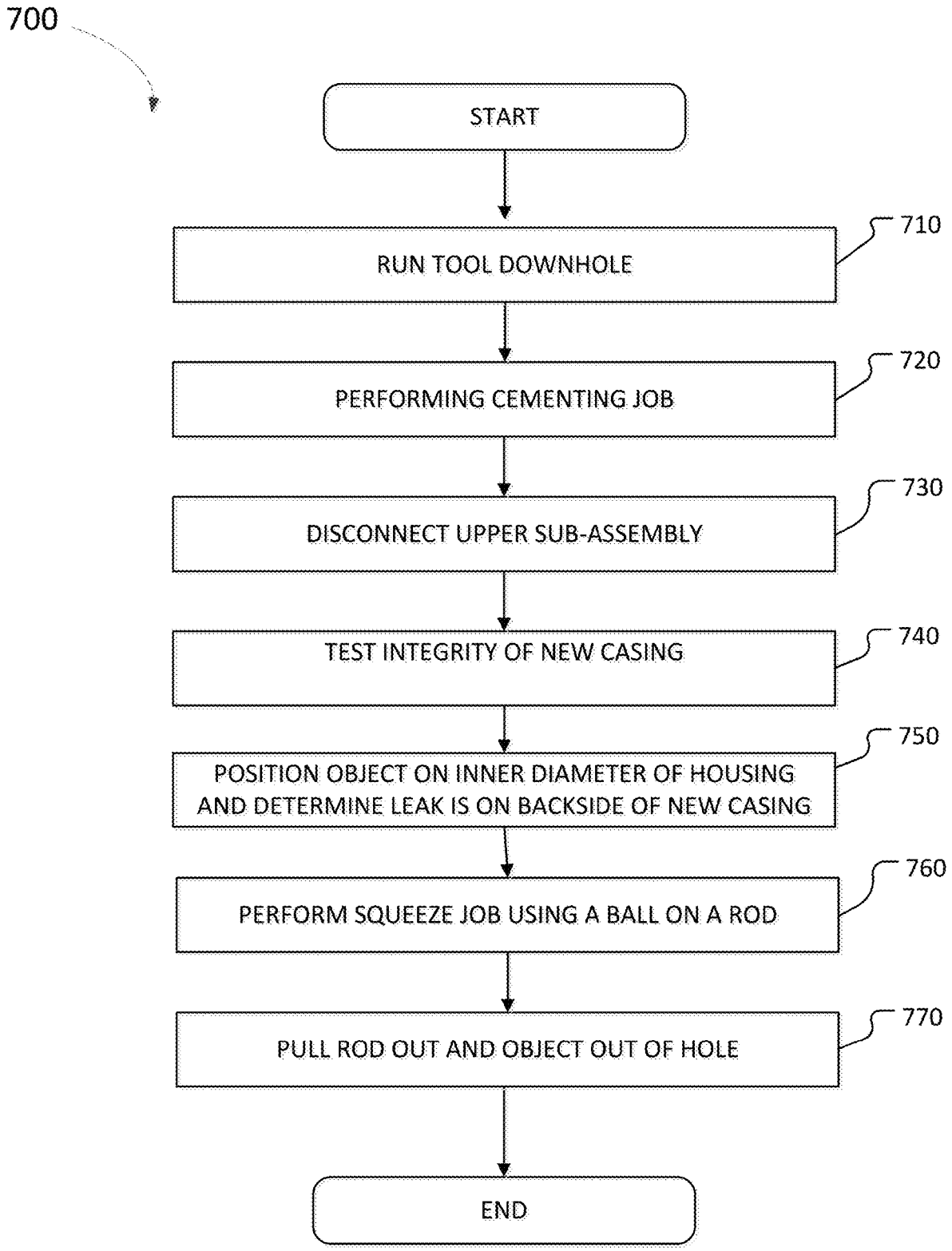
FIG. 7 depicts an interventionless method for detaching an upper sub-assembly from a bottom sub-assembly, according to an embodiment.

FIG. 7 depicts a method 700 for an interventionless system for testing casing, according to an embodiment. The operations of method 700 presented below are intended to be illustrative. In some embodiments, method 700 may be accomplished with one or more additional operations not described, and/or without one or more of the operations discussed. Additionally, the order in which the operations of method 700 are illustrated in FIG. 7 and described below is not intended to be limiting. Furthermore, the operations of method 700 may be repeated for subsequent valves or zones in a well.

At operation 710, a tool with housing, an upper sub-assembly, and bottom sub-assembly may be positioned within a wellbore on a shoe.

At operation 720, a conventional casing cement job may be performed. The cement job may be performed by pumping cement through the tool, and having the cement return towards a surface in an annulus between the tool and a wellbore wall or existing casing.

At operation 730, an upper sub-assembly may be disconnected from a lower sub-assembly and a housing. In embodiments, the upper sub-assembly may be disconnected by positioning a ball on a support sleeve of the upper sub-assembly. The ball to isolate an area above the ball from an area above the ball. Then, pressure in the area above the ball within the tool may increase. Responsive to increasing the pressure above the ball within the tool, a shear pin coupling the support sleeve to an adjuster sleeve may shear. The pressure may cause the support sleeve to move towards the distal end of the tool while the adjuster sleeve remains in place. When the support sleeve moves, a distal end of the adjuster sleeve may no longer be aligned with a first outcrop on the support sleeve. This may cause the distal end of the adjuster sleeve to become disengaged with a stop within the casing, and move towards a central axis of the tool. Next, the upper sub-assembly may be mechanically pulled towards proximal end of tool while the housing and lower sub-assembly remain downhole to provide new casing.

At operation 740, the integrity of the new casing, cement, and existing perforations within the old casing may be tested by increasing pressure downhole. The testing of the casing and cement may indicate that there is a leak.

At operation 750, a ball on a rod may be positioned downhole and land on a profile positioned on an inner circumference of the housing. This may separate a backside of the casing from the casing shoe, such that the backside of the casing may be tested independently from the shoe. Then pressure above the dissolvable ball may be increased to determine that there is a leak on the backside of the casing.

At operation 760, a squeeze job may be performed on the backside of the casing via ports positioned through the rod, with the ball attached to the bottom of the rod.

At operation 770, the rod and the ball may be pulled out of hole. Accordingly, the new casing may be tested and treated in a single run without positioning any new tools downhole.

Figure 8:
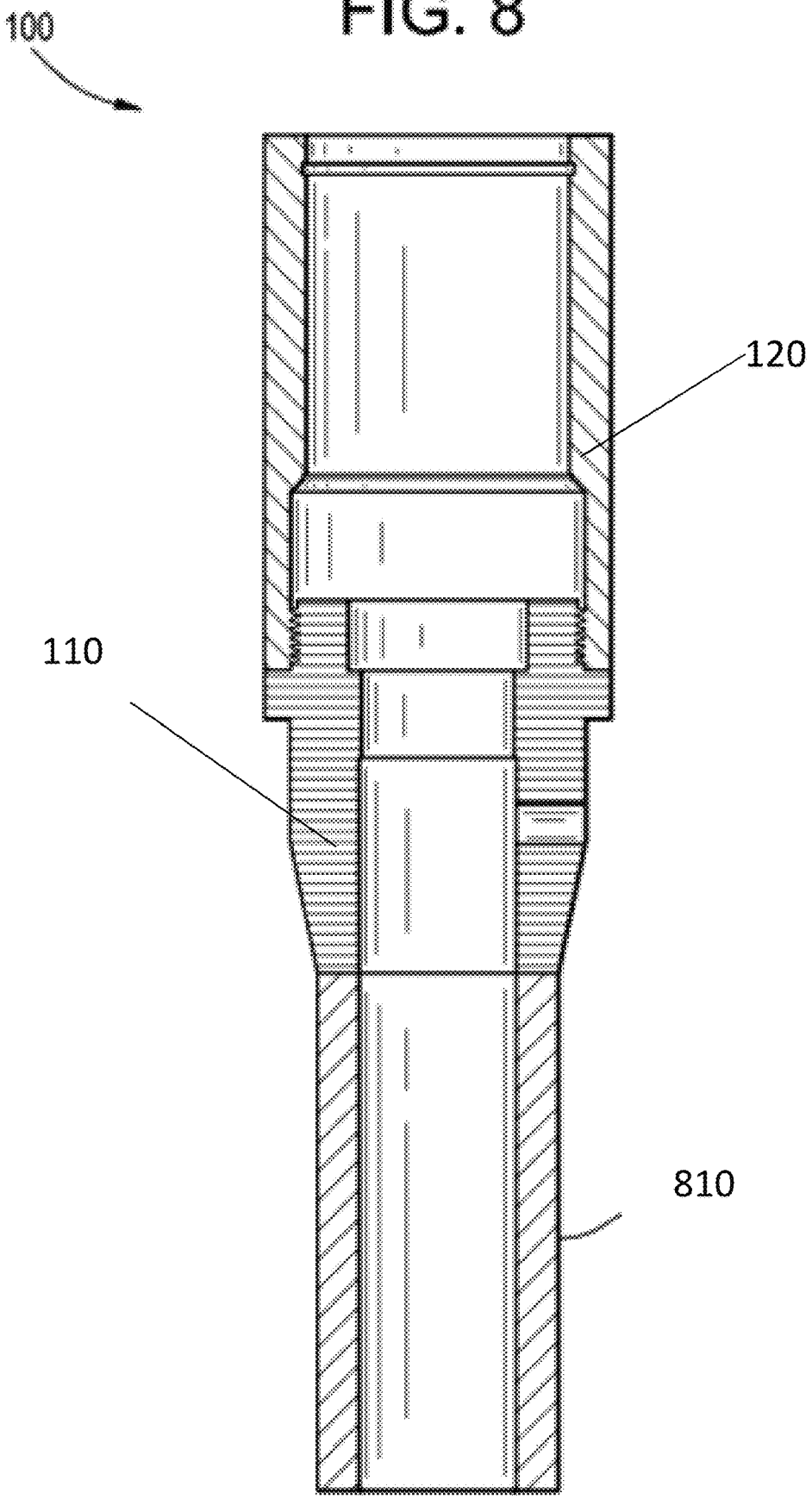
FIG. 8 depicts a tool, according to an embodiment.
Figure 9:
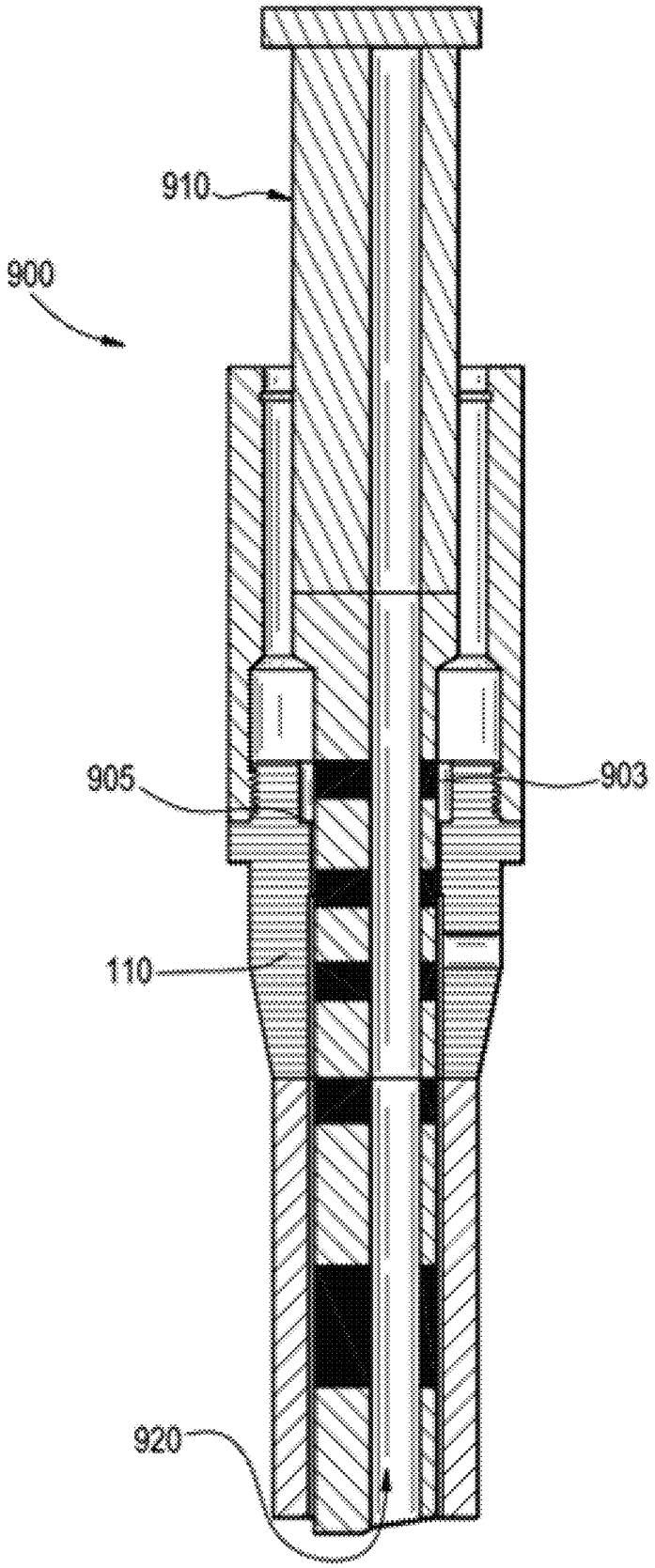
FIG. 9 depicts a tool, according to an embodiment.

FIGS. 8 and 9 depict a tool 100, according to an embodiment. Elements depicted in FIGS. 8 and 9 may be described above, and for the sake of brevity a further description of these matters is omitted.

As depicted in FIG. 8, a seal bore 810 may be positioned on an end of bottom sub-assembly 110. As depicted in FIG. 8, this may allow bottom sub-assembly 110 to become an integral and permanent part of casing already deployed downhole. In embodiments, seal bore 810 may have a smaller diameter than that of housing 120, such that seal bore 810 may be inserted on or within deployed casing to have outer diameter of the casing that is substantially similar to that of housing 120 when seal bore 810 is positioned within the existing, already deployed, casing. As such, bottom sub-assembly 110 and housing 120 may form a top of a casing liner with a casing with a substantially similar outer diameter with that of the existing casing.

As depicted in FIG. 9, responsive to upper sub-assembly 130 being removed from the wellbore, production tubing 910 and a seal assembly 920 may be inserted through the tool 100 and seal bore 810. Utilizing the beveled edges, rims, etc. 903, 905 positioned on the inner diameter of bottom sub-assembly 110 production tubing and seal assembly 920 may be more efficiently and easily positioned within tool 100.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A method for interventionless testing of casing comprising:

positioning a tool downhole, the tool including an upper sub-assembly, lower sub-assembly, and housing, wherein the tool is run in hole as a single assembly in a single run;

performing a cement job through the tool;

disconnecting the upper sub-assembly from the lower sub-assembly and the housing;

retrieving the upper sub-assembly while the housing and lower sub-assembly remain downhole, wherein the housing and lower sub-assembly form a new casing string on deployed casing, wherein a backside is positioned between the new casing and an old casing;

testing the new casing;

positioning an object downhole within the housing after the upper sub-assembly is disconnected from the lower sub assembly to determine if a squeeze job is required to be performed, wherein the object separates a first zone below the object within an inner diameter of the new casing string from a second zone associated with the backside, wherein the determination is based on pressure testing the second zone.

2. The method of claim 1, wherein the object is run in hole on a rod.

3. The method of claim 2, wherein the squeeze job is performed through ports extending through the rod.

4. The method of claim 3, wherein a proximal end of the housing forms a proximal end of a casing liner, and the squeeze job is performed at a location proximate to the proximal end of the casing liner in the backside while the object is positioned within the housing and isolating the first zone from the second zone.

5. The method of claim 3, wherein the rod and ball are retrieved together.

6. The method of claim 1, wherein the object is dissolvable.

7. The method of claim 1, wherein the object is positioned on an object seat within the housing.

8. The method of claim 1, wherein the tool is positioned in a cased hole.

9. The method of claim 1, wherein the tool is positioned in an open hole.

10. The method of claim 1, wherein the squeeze job and the testing is performed in a single run without positioning any new tools downhole.

11. The method of claim 1, a proximal end of bottom sub-assembly includes a beveled rim that is configured to receive the object.

12. The method of claim 1, further comprising:

positioning a burst disc in a passageway through the tool, the burst disc being configured to form a seal before forming the cement job.

13. The method of claim 12, further comprising:

rupturing the burst disc before positioning the first object within the tool.

14. The method of claim 13, wherein the passageway is through the upper sub-assembly.

15. The method of claim 13, wherein the passageway is through the lower sub-assembly.

16. The method of claim 13, wherein the lower sub assembly is an anchor system configured to grip the new casing string to the old casing.

* * * * *